US006364273B1

(12) United States Patent
Otema

(10) Patent No.: US 6,364,273 B1
(45) Date of Patent: Apr. 2, 2002

(54) LIGHT RAIL FOR A SHELF AND SHELF WITH LIGHT RAIL

(76) Inventor: Martin Otema, 15 Pine Ridge Dr., Scarborough, Ontario (CA), M1M 2X4

( * ) Notice: Subject to any disclaimer, the term of this patent is extended or adjusted under 35 U.S.C. 154(b) by 0 days.

(21) Appl. No.: 09/546,904

(22) Filed: Apr. 10, 2000

(51) Int. Cl.[7] ..... A47B 5/04

(52) U.S. Cl. ..... 248/444.1; 40/559; 40/600; 248/235; 362/147; 362/223; 362/225

(58) Field of Search ..... 248/235, 222.11, 248/244.1; 40/558, 559, 600, 564, 553; 362/147, 223, 225

(56) References Cited

U.S. PATENT DOCUMENTS 4,653,209 A * 3/1987 Cobb ..... 40/618
4,856,216 A * 8/1989 Gross ..... 40/559
5,025,355 A * 6/1991 Harwood ..... 362/147
5,270,910 A * 12/1993 Kile ..... 362/216
5,644,860 A * 7/1997 Piper et al. ..... 248/222.11
5,729,924 A * 3/1998 Reading ..... 40/564

* cited by examiner

*Primary Examiner*—Ramon O. Ramirez
*Assistant Examiner*—Tan Le
(74) *Attorney, Agent, or Firm*—Dimock Stratton Clarizio; Mark B. Eisen

(57) ABSTRACT

A shelf having a light rail extending along a front edge of the shelf which comprises a cover adapted to reflect light onto displayed merchandise while permitting light to pass through selected window portions to illuminate product and pricing information printed on transparent or translucent signage. Signage may also be supported on a sign strip behind the light rails, and along the front edge of the shelf board. In the preferred embodiment wire management is provided by a raceway formed between a cover support and a backing strip for the fluorescent tube. A receptacle in communication with the wiring within the raceway is adapted to receive a connector from the ballust transformer, so that all permanent wiring for the fluorescent tube is concealed within the raceway. The ballust transformer can be unplugged from the wall receptacle and from the raceway receptacle, to thus completely remove the ballust transformer from the shelf for repair or replacement.

20 Claims, 6 Drawing Sheets

LIGHT RAIL FOR A SHELF AND SHELF WITH LIGHT RAIL

FIELD OF INVENTION

This invention relates to shelving systems. In particular, this invention relates to a light rail for a shelf and a shelf embodying the light rail, having novel product signage capability.

BACKGROUND OF THE INVENTION

Many different types of shelving systems are used for displaying retail merchandise. The most common standard system used for supporting shelves in retail shelving systems utilizes a slotted standard, which is essentially a metal channel with a main face having a column of vertical slots. Various shapes and styles of brackets are designed with one, two or three barbed or hooked flanges spaced to fit into the slots in the standard. An example is described and illustrated in U.S. Pat. No. 5,575,444 issued Nov. 19, 1996 to Otema, which is incorporated herein by reference.

The success of many types of retail merchandise, for example perfumes, cosmetics and the like, is heavily dependent upon presentation. Much of the cost of manufacturing these types of product is devoted to the retail packaging, with a large portion of the cost attributable to the artwork, design and fabrication that goes into the retail packaging. Accordingly, it is desirable to display such products in a manner that accents the form and presentation of the retail packaging.

For this purpose, lighted shelving systems have been developed which cast a uniform light onto displayed merchandise. In many such systems the merchandise is front-lit, highlighting the front of the packaging and reducing the effects of shadows, which detract from the aesthetic appeal of the product.

However, such shelving systems present a number of disadvantages. The light rail bordering the exposed sides of the shelving takes up valuable signage space which is conventionally used for product and pricing information displayed immediately above or beneath the product with which it is associated. The electrical lights typically used in lighted shelving systems are fluorescent tubes, which require a ballust transformer and wires extending along the entire length of the tube. Managing the wiring for such a lighting system is awkward, and wires can interfere with both the functionality and the desirable anesthetics of the shelving. Permanently connecting the lighting to a power source renders maintenance and replacement of the ballast transformer difficult, and the available flexibility in repositioning the shelves, which is one of the main reasons that the slotted standard is favored as a shelving system, can be significantly reduced.

It would accordingly be advantageous to provide a shelving system having a light rail that adequately illuminates displayed merchandise but still allows for product and pricing information displayed immediately adjacent to the product with which it is associated. It would further be advantageous to provide a shelving system having wire management capabilities, to both conceal and protect the wiring for the light, while at the same time allowing for easy maintenance and replacement of the ballust transformer and maintaining available flexibility in repositioning the shelves in the shelving system as desired to accommodate new merchandise.

SUMMARY OF THE INVENTION

The present invention overcomes these disadvantages by providing a light rail for a shelf and a shelf incorporating the light rail. The light rail of the invention illuminates both displayed merchandise and product and pricing information, which can be displayed immediately adjacent to the product with which it is associated. In the preferred embodiment the light rail and shelf of the invention further incorporates a wire management raceway to conceal and protect the wiring for the light, which thus does not obstruct the display area.

In the preferred embodiment the ballust transformer is integrated as a plug-in component, allowing for easy maintenance and replacement of the ballast transformer, and the lighting system is adapted to be connected to a conventional duplex receptacle through a standard power cord, so as to maintain flexibility in repositioning the shelves of the shelving system. The ballust transformer may alternatively be an electronic transformer concealed within the wire management channel.

The invention accomplishes this by providing a shelf having a light rail extending along a front edge of the shelf. The light rail comprises a cover adapted to reflect light onto displayed merchandise while permitting light to pass through selected window portions to illuminate product and pricing information on translucent or transparent signage. In the preferred embodiment the signage is supported between a pair of opposed flanges inside the cover, which facilitates replacing product and pricing information as new merchandise is loaded into the display. The cover is preferably hinged to the light rail so as to be pivotable between a closed position in which the cover reflects light onto the merchandise, and an open position which allows access to the product and pricing signage and to the fluorescent tube for replacement.

Additional indicia such as product and pricing information may be featured on a tag or label affixed to a sign strip disposed behind the light rail, and/or along a front edge of the shelf board or a front shelf support.

In the preferred embodiment wire management is provided by a channel formed between a cover support extending across the front edge of the shelf, and a backing strip for the fluorescent tube. A connector in communication with the wiring within the raceway is adapted to receive a complimentary connector from the ballust transformer, so that the ballust transformer can be unplugged from the wall receptacle and from the raceway receptacle, to thus completely remove the ballust transformer from the shelf for repair or replacement. Alternatively an electronic ballust transformer may be disposed in the channel, so that all permanent wiring for the fluorescent tube is concealed within the wire management channel.

The present invention thus provides a light rail for a shelf mountable on a display, the shelf comprising a frame having spaced apart mounting members, the light rail being mounted along a front portion of the frame and comprising a cover having one or more windows for allowing the passage of light through the cover and one or more receptacles for a light source, wherein when transparent or translucent signage is mounted adjacent to or in a window light emitted by a light source passes through the signage to illuminate the signage from the rear and reflects off of the cover to illuminate articles stored on the shelf from the front.

The present invention further provides a light rail for a shelf mountable on a display, the shelf comprising a frame having spaced apart mounting members, the light rail comprising a light support member comprising a front ridge and a rear ridge defining a wire management channel, a light support plate forming a cover for the wire management channel, and one or more receptacles for a light source mounted in fixed relation to the light support plate, wherein wires conveying power to the receptacles are disposed within the wire management channel.

BRIEF DESCRIPTION OF THE DRAWINGS

In drawings which illustrate by way of example only a preferred embodiment of the invention.

DETAILED DESCRIPTION OF THE INVENTION

Figure 1:
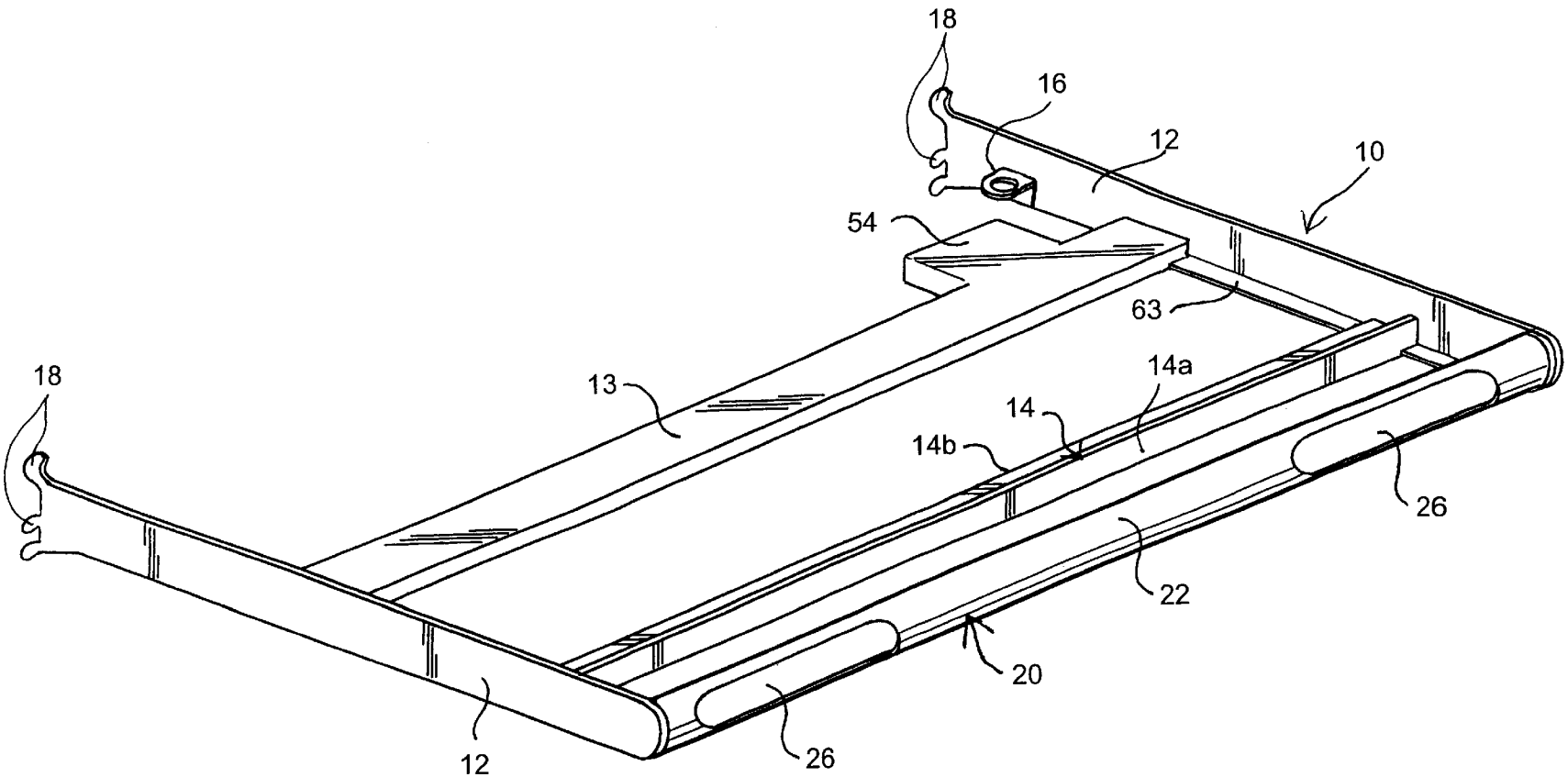
FIG. 1 is a top perspective view of the light rail and frame for an illuminated shelf of the invention.
Figure 2:
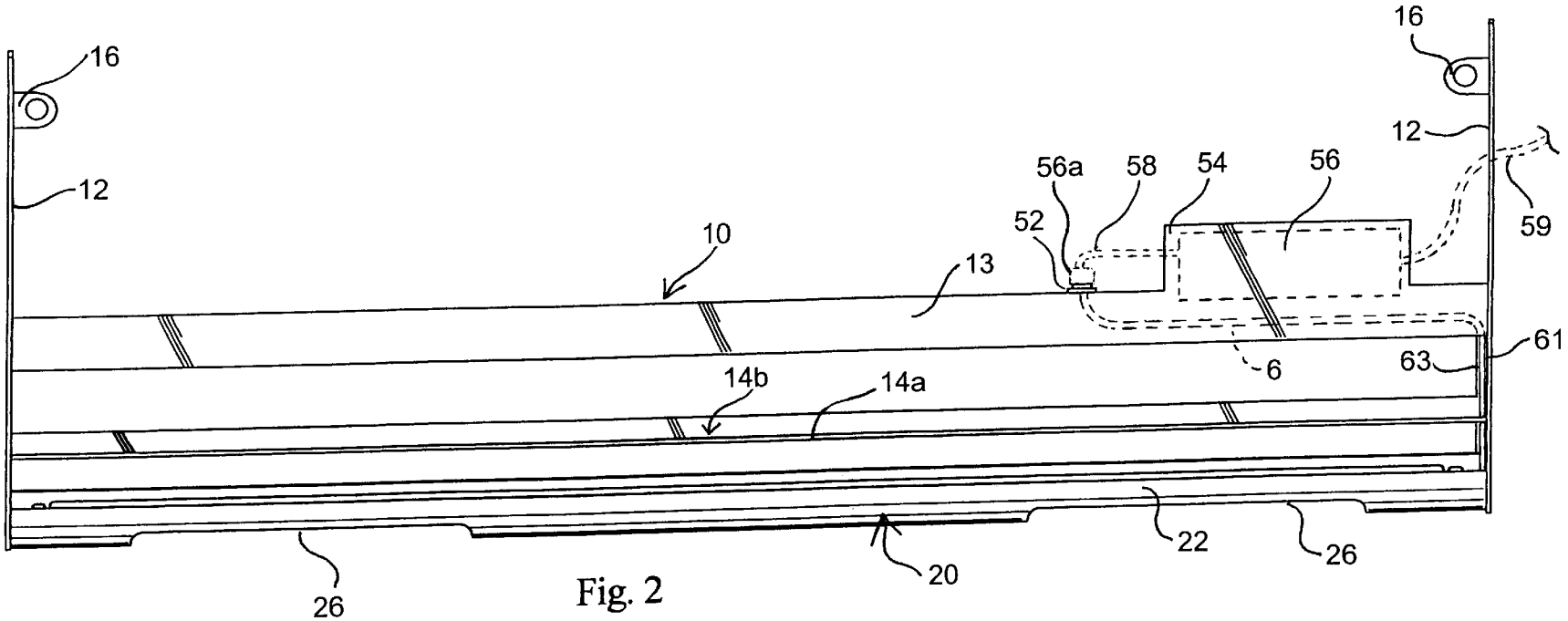
FIG. 2 is a top plan view of the frame of FIG. 1.
Figure 3:
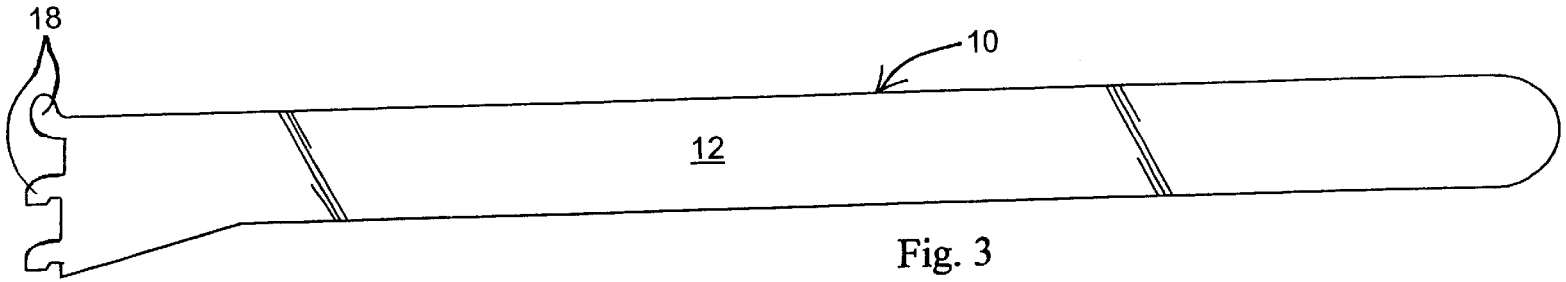
FIG. 3 is a side elevation of the frame of FIG. 1.
Figure 4:
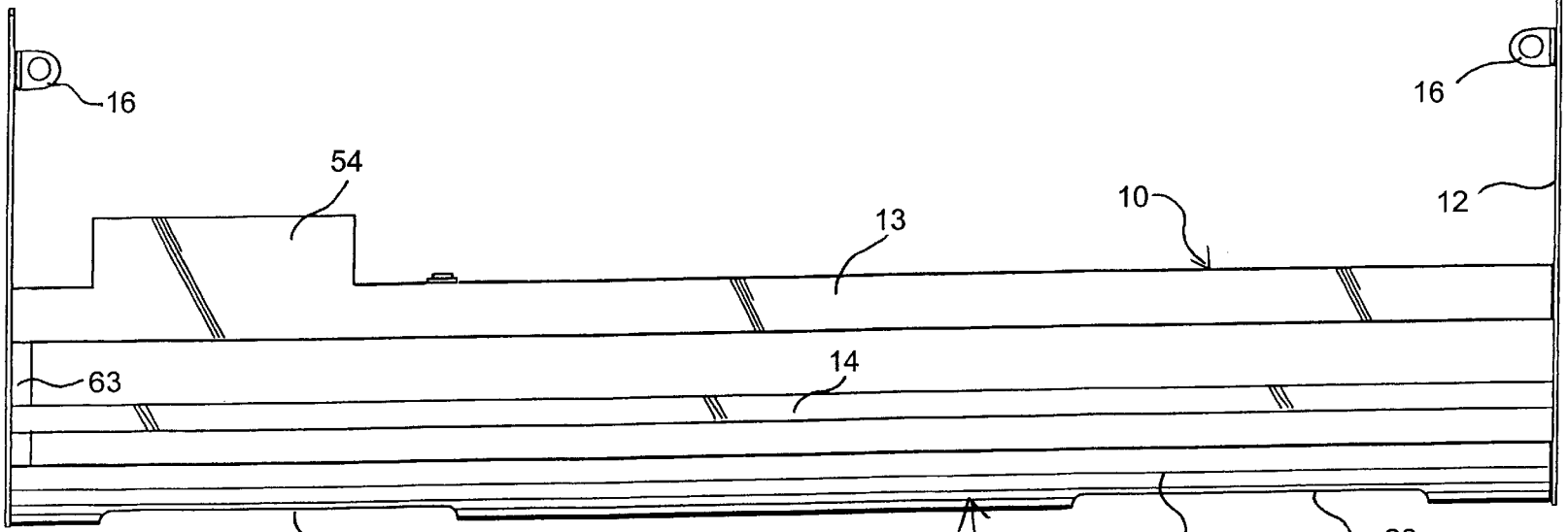
FIG. 4 is a bottom plan view of the frame of FIG. 1.
Figure 5:
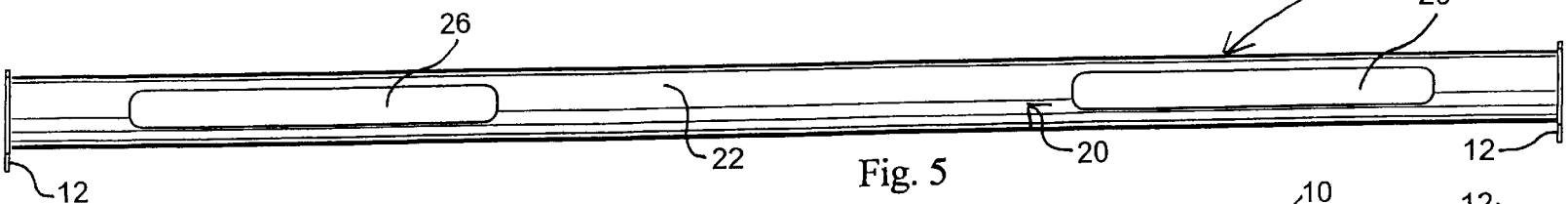
FIG. 5 is a front elevation of the frame of FIG. 1.
Figure 6:
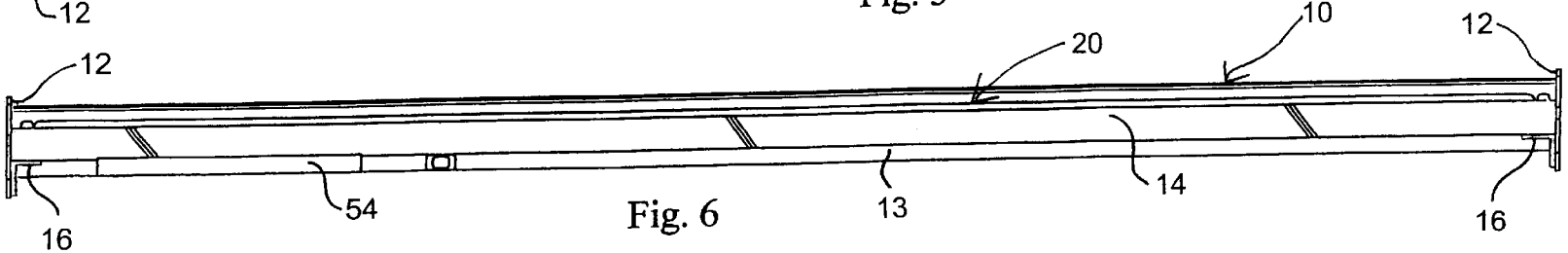
FIG. 6 is a rear elevation of the frame of FIG. 1.

As illustrated in FIGS. 1 to 6, a frame 10 for the shelf of the invention comprises a pair of mounting members 12 connected together by a rear crossbar 13 and a front crossbar 14. The front crossbar 14 includes a shelf retainer 14*a* for retaining a shelf board 2 in position, and a floor 14*b* at the level of the underside of the shelf board 2, to support the front of the shelf board 2. In the embodiment shown the mounting members 12 form sides of the frame 10, and are preferably configured to complement the profile of the shelf board 2 and the light rail 20. However, the mounting members 12 may alternatively be inset from the sides of the frame, as suitable for the intended application.

The mounting members 12 also each provide a rear shelf support 16 at the level of the floor 14*a* to support the shelf board 2 in a horizontal orientation. The shelf supports 16 may have an opening to facilitate lifting the shelf board 2 from beneath the frame 10 when the sides of the shelf board 2 are inaccessible.

The mounting members 12 provide any suitable structure for mounting the shelf to a standard or display unit, for example hooks 18 for mounting the shelf to a slotted standard (not shown) or any other compatible mounting structure. It will be appreciated that the manner of mounting the shelf of the invention may be in any suitable fashion and the invention is not intended to be restricted thereby.

Figure 7:
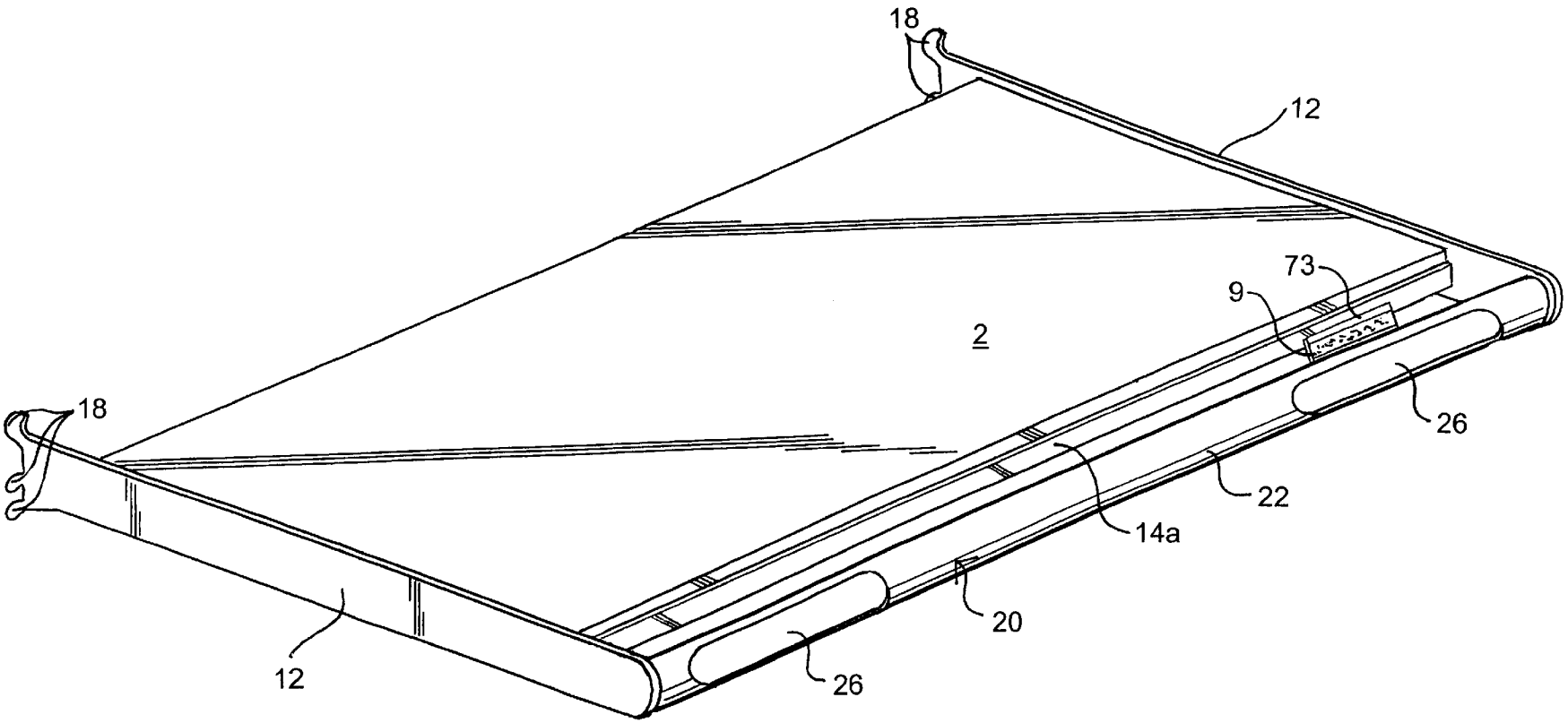
FIG. 7 is a top perspective view of the frame of FIG. 1 showing the shelf in position on the frame.

The shelf board 2 may be made of any suitable material, including wood, plastic, metal or glass, and preferably extends from the rear shelf supports 16 to the front shelf support 14*b*, preferably to fit snugly against the shelf retainer 14*a*, spaced from the light rail 20, which allows signage to be positioned along the front of the shelf retainer 14*a* (and/or along the front of the shelf board 2, if it projects above the shelf retainer 14*a*) where the signage is illuminated by the light rail 20. The shelf board 2 is shown in position on the frame 10 in FIG. 7.

Figure 8:
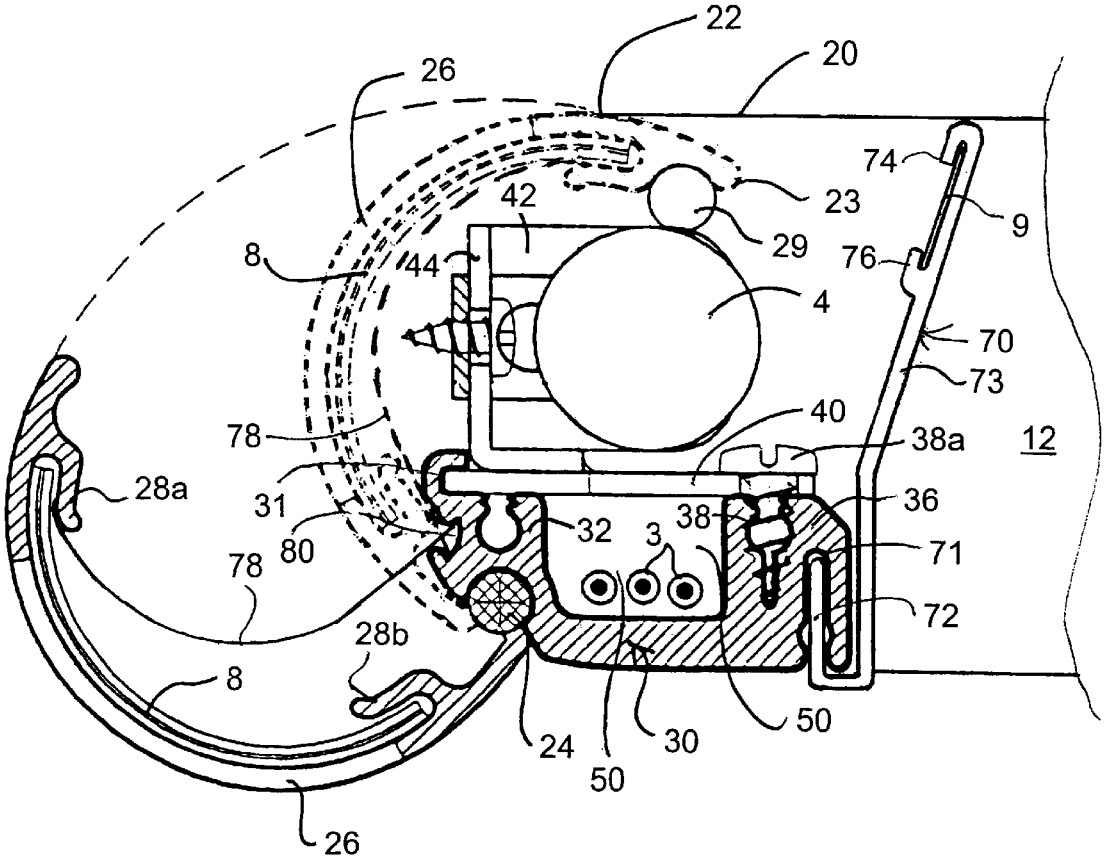
FIG. 8 is a cross-sectional elevation of a first preferred embodiment of the light rail.

An embodiment if the light rail 20 for a straight shelf is shown in detail in FIG. 8. The light rail 20 comprises a curvate cover 22 preferably extending approximately 180 degrees from a hinge 24 at the bottom of the cover 22 to the free edge 23 of the cover 22. The cover 22 is mounted at hinge 24 along the front edge of a light support member 30, to thus pivot between a closed position in which the cover conceals the fluorescent light tube 4 and reflects light onto the merchandise, as shown in phantom in FIG. 8, and an open position which allows access to signage 8 and to the fluorescent tube 4 for replacement, as shown in solid lines in FIG. 8. Optionally a stop 29 projects from each side member 12 into the path of the cover 22, to prevent the cover 22 from collapsing onto the fluorescent tube 4 if excess weight is applied to the cover 22.

The cover 22 has at least one front window 26 which allows light to escape through the cover 22, the number of windows being a matter of selection according to the length of the shelf and the variety of merchandise to be stocked on the shelf. Translucent or transparent signage 8 containing product information, pricing information and/or any other desired indicia, described below, is mounted adjacent to the windows 26 in any convenient fashion. In the embodiment shown lips 28*a*, 28*b* extending along the interior of the cover 22 about the region of the windows 26 are provided for mounting the translucent signage 8 in slip-fit relation. Optionally an acrylic or other transparent lens (not shown) may cover or nest within the windows 26. Also, if the cover 22 is a dark color, optionally a white or other light colored translucent backing strip (not shown) can be mounted between the lips 28*a*, 28*b* extending across substantially the entire cover 22, to reflect light from the light source 4 back onto articles stored on the shelf.

The signage 8 may alternatively be mounted within the windows 26, or on the front of the cover 22, so long as light passing through the windows 26 back-lights the signage 8 for illumination thereof.

The light support member 30 preferably comprises an extrusion which is attached to the front of the frame 10 by being screwed or otherwise affixed to the mounting members 12, or otherwise affixed to the frame 10. The light support member 30 comprises a front ridge 32, which preferably provides a return lip 31 to capture the light support plate 40, and a rear ridge 36 provided with a slot 38 for affixing the light support plate 40 to the support member 30 using self-tapping screws 38*a*. A wire management channel 50 is thus formed between the ridges 32, 36, for concealing and protecting wires 3 conveying power to the light tube 4.

The fluorescent tube sockets 42 are mounted to brackets 44 welded or otherwise affixed to the light support plate 40 at the ends thereof, shown in FIG. 8 immediately inside the mounting members 12. Wires 3 conveying power to the receptacles 42 are disposed within the wire management channel 50 before the light rail 20 is assembled, and are connected within the channel 50 to a receptacle 52 (shown in FIG. 2). A ballust transformer 56 (shown in phantom in FIG. 2) may be mounted on a transformer support plate 54 formed with or attached to the rear crossbar 13, or on the crossbar 13 itself, and a cord 58 with compatible connector 56*a* electrically connects the transformer 56 to the fluorescent tube wiring 3 through a wire 61 disposed along wire raceway 63. The line side of the transformer 56 is provided with a conventional power cord 59 for plugging the transformer 56 into a duplex wall receptacle, floor monument or the like (not shown) to power the light. Alternatively, an electronic ballust transformer (not shown) may be mounted directly in the wire management channel 50.

The cover 22 is preferably biased to the open and closed positions by leaf springs 78 lodged in a recess or channel 80 formed in the light support member 30. The spring 78 may be configured to engage the upper lip 28*a* of the cover, and the profile of the recess 80 allows the lower edge of the spring 78 to toggle between the upper wall of the recess 80 (when the cover 22 is open) and the lower wall of the recess 80 (when the cover 22 is closed), as shown in FIG. 8. Thus, the spring 80 biases the cover 22 to the open position when the cover 22 is fully open, and biases the cover 22 to the closed position when the cover 22 is fully closed. The spring 78 is mounted in a position where it does not obscure the windows 26.

In operation, the wires 3 are connected to the fluorescent tube sockets 42 and installed into the channel 50 of the light support member 30, and the light support plate 40 is inserted into slot 31 and screwed to the light support member 30 by screws 38*a*. A fluorescent tube 4 is installed into the sockets 42 and the cover 22 is pivoted to the closed position shown in solid lines in FIG. 8. A suitable ballust transformer 56 is placed on the transformer support plate 54 and the load side connector 56*a* is connected to the complimentary connector 52.

The frame 10 is mounted to a standard, for example by engaging hooks 18 to a slotted standard (not shown). The power cord 59 is plugged into a duplex wall receptacle, floor monument, extension cord or any other suitable power source to energize the light tube 4. The shelf board 2 is placed on the frame 10 overlapping both the floor 14*b* of the front shelf support 14 and the rear shelf supports 16, snugly against the shelf retainer 14*a* and thus spaced from the light rail 20.

The invention provides signage 8 in the form of a translucent sheet of preferably (but not necessarily) flexible material, for example Mylar™, which is removably fixed over the window 26 and diffuses light emitted from the light tube 4, which back-lights the signage 8. In the embodiment shown the signage 8 slip-fits into the lips 28*a*, 28*b*, which in an extrusion such as that shown may extend along the length of the cover 22, however the signage 8 may alternatively be screwed, taped or otherwise suitably affixed, preferably removably, in a position where it covers the window 26. The signage 8 may have opaque indicia such as lettering, or translucent indicia in a contrasting color, or may consist of multiple sheets, for example a translucent sheet backing opaque indicia or transparent sheet having cutout indicia, etc., in any way which allows light to escape through the signage 8 and provides a contrast between the signage background and indicia.

Optionally a sign strip 70 is affixed to the light support member 30, to support signage 9 with additional indicia behind the light rail 20. In the embodiment shown sign strip 70 comprises a lower return flange 72 which seats in a slot 71 in the bottom of the light support member 30, and a body 73 from which lips 74, 76 project for receiving signage 9. The sign strip 70 may be mounted in other ways, for example by screws, tape etc., it being preferably positioned so as to be front-lit by the light tube 4. Additional signage may be disposed along the front edge of the shelf retainer 14*a*, and/or the front edge of the shelf board 2, also front-lit by the light tube 4.

Figure 9:
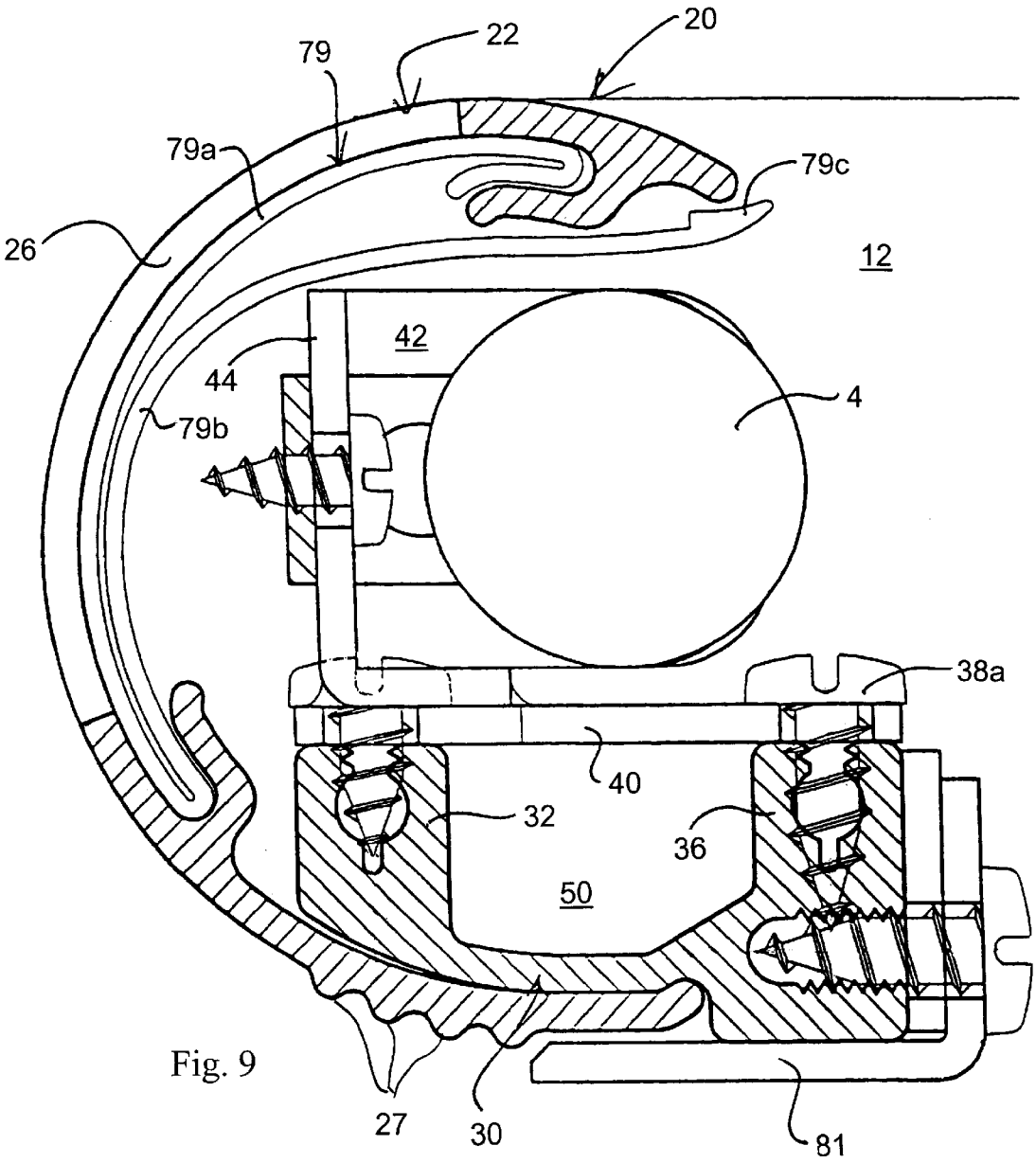
FIG. 9 is a cross-section of a further preferred embodiment of the light rail cover.

FIG. 9 illustrates an embodiment of the invention for a curvate shelf, having a snap-on removable cover 20, providing ridges 27 for grasping to remove the cover 20. A retaining bracket 81 screwed to the light support member 30 secures the cover 20 in position.

This embodiment shows a transparent or translucent filler strip 9 formed from a flexible sheet, extruded or otherwise configured so that a front portion 79*a* of the sheet and the crease respectively fit into the lips 28*a*, 28*b*, while a free end 79*c* of a rear portion 79*b* of the sheet remains free for grasping. This embodiment facilitates mounting, removal and replacement of signage 8, which is inserted between the overlapping portions of the insert strip 79. The free end 79*c* preferably includes a barb, which retains the signage 8 and compressively urges the signage 8 against the inner wall of the cover 22. The barb also facilitates removal of the signage 8, which springs partly out of the filler strip 79 when the barb is depressed and dislodged from the edge of the signage 8. The insert strip 9 may also have indicia, for use by itself or to compliment indicia on signage 8 inserted into the filler strip 9.

Product and or pricing information can thus be displayed in a plurality of locations which are highly visible to a viewer Translucent or transparent signage 8 (or a combination thereof) may be mounted to the light rail cover 22 by opening the cover 22 and sliding the signage strip between the mounting lips 28, back-lit by the light rail 20 so that light escaping through the windows 26 illuminates the signage 8. Signage 9 may be supported on the sign strip 70 to be front-lit by the light rail 20, and additional signage (not shown) may be mounted along the front edge of the shelf board 2 to be front-lit by the light rail 20, either or both of which may advantageously be opaque or reflective.

A preferred embodiment of the invention having been thus described by way of example only, it will be apparent to those skilled in the art that certain modifications and adaptations may be made without departing from the scope of the invention, as set out in the appended claims.

I claim:

1. A light rail for a shelf mountable on a display, the shelf comprising a frame having side members spaced apart in fixed relation, the light rail being mounted along a front portion of the frame and comprising a light source disposed in front of the shelf, a cover disposed in front of the light source, having an interior surface for reflecting light from the light source toward the shelf and one or more windows for allowing the passage of light through the cover, whereby when the cover is in position in front of the light source, light emitted by the light source passes through the one or more windows to illuminate from the rear transparent or translucent signage mounted over the one or more windows, and reflects off of the interior surface of the cover to illuminate the shelf.

2. The light rail of claim 1 wherein the cover is hinged to the light rail and movable between an open position and a closed position, and in the closed position the cover is in position in front of the light source.

3. The light rail of claim 2 wherein the cover in the open position allows access to the light source and the signage.

4. The light rail of claim 3 wherein the cover is hinged to a light support member.

5. The light rail of claim 4 wherein the light support member forms a wire management channel.

6. The light rail of claim 5 wherein a ballust transformer coupled to the light source is supported on the light rail.

7. The light rail of claim 5 wherein the ballust transformer comprises a conventional power cord for connection to a wall receptacle.

8. The light rail of claim 1 wherein the cover is curvate about a longitudinal axis.

9. The light rail of claim 1 wherein the signage is slip-fit mounted between a pair of lips adjacent to opposite edges of the one or more windows.

10. The light rail of claim 3 wherein a sign strip is affixed to the light rail behind the light source, to be illuminated by light reflecting off of the interior surface of the cover.

11. The shelf of claim 1 wherein the signage is slip-fit mounted between a pair of lips adjacent to opposite edges of the one or more windows.

12. A shelf mountable on a display, comprising a frame having side members spaced apart in fixed relation, a light rail mounted along a front portion of the frame and comprising a light source, and a cover disposed in front of the light source, having an interior surface for reflecting light from the light source toward the shelf and one or more windows for allowing the passage of light trough the cover, whereby when the cover is in position in front of the light source, light emitted by the light source passes through the one or more windows to illuminate from the tear transparent or translucent signage mounted over the one or more windows, and reflects off of the interior surface of the cover to illuminate the shelf.

13. The shelf of claim 12 wherein the cover is hinged to the light rail and movable between an open position and a closed position, and in the closed position the cover is in position in front of the light source.

14. The shelf of claim 13 wherein the cover in the open position allows access to the light source and the signage.

15. The shelf of claim 14 wherein the cover is hinged to a light support member.

16. The shelf of claim 15 wherein the light support member forms a wire management channel.

17. The shelf of claim 16 wherein a ballust transformer coupled to the light source is supported on the light rail.

18. The shelf of claim 16 wherein tee ballast transformer comprises a conventional power cord for connection to a wall receptacle.

19. The shelf of claim 12 wherein the cover is curvate about a longitudinal axis.

20. The shelf of claim 13 wherein a sign strip is affixed to the light rail behind the light source, to be illuminated by light reflecting off of the interior surface of the cover.

* * * * *